US009638069B2

(12) United States Patent
Yoon et al.

(10) Patent No.: US 9,638,069 B2
(45) Date of Patent: May 2, 2017

(54) CAM CARRIER MODULE FOR VEHICLES

(71) Applicants: Hyundai Motor Company, Seoul (KR); Kia Motors Corp., Seoul (KR)

(72) Inventors: Seok Jun Yoon, Anyang-si (KR); Kye Oong Song, Yongin-si (KR)

(73) Assignees: Hyundai Motor Company, Seoul (KR); Kia Motors Corp., Seoul (KR)

( * ) Notice: Subject to any disclaimer, the term of this patent is extended or adjusted under 35 U.S.C. 154(b) by 94 days.

(21) Appl. No.: 14/674,843

(22) Filed: Mar. 31, 2015

(65) Prior Publication Data

US 2016/0108765 A1 Apr. 21, 2016

(30) Foreign Application Priority Data

Oct. 16, 2014 (KR) ..... 10-2014-0139789

(51) Int. Cl.

| | |
|---|---|
| ***F01L 1/053*** | (2006.01) |
| ***F02F 7/00*** | (2006.01) |
| ***F01M 9/10*** | (2006.01) |
| ***F01L 1/18*** | (2006.01) |
| ***F02F 1/38*** | (2006.01) |
| *F01L 1/047* | (2006.01) |

(52) U.S. Cl.

CPC ..... *F01L 1/053* (2013.01); *F01L 1/185* (2013.01); *F01M 9/102* (2013.01); *F02F 1/38* (2013.01); *F02F 7/006* (2013.01); *F01L 2001/0476* (2013.01); *F01L 2001/0537* (2013.01); *F01L 2250/02* (2013.01); *F01L 2250/04* (2013.01); *F01L 2810/02* (2013.01)

(58) Field of Classification Search

CPC .. F01L 1/053; F01L 1/185; F02F 7/006; F02F 1/38

USPC ..... 123/193.5, 193.3, 294, 90.27

See application file for complete search history.

(56) References Cited

U.S. PATENT DOCUMENTS

| | | | | |
|---|---|---|---|---|
| 4,538,561 | A * | 9/1985 | Amemori | F01L 1/024 123/193.5 |
| 6,170,467 | B1 * | 1/2001 | Girard | F02F 7/006 123/470 |
| 6,408,808 | B1 * | 6/2002 | Yi | F01L 1/02 123/193.3 |
| 6,796,281 | B2 * | 9/2004 | Shimoyama | F01L 1/053 123/188.2 |
| 6,895,942 | B2 * | 5/2005 | Iitaka | F01L 1/053 123/195 A |
| 2003/0094155 | A1 * | 5/2003 | Shimoyama | F01L 1/053 123/188.2 |
| 2009/0126674 | A1 * | 5/2009 | Takasu | F02F 1/242 123/193.5 |

FOREIGN PATENT DOCUMENTS

| | | |
|---|---|---|
| JP | 58-79 U | 1/1983 |
| JP | 2-153208 A | 6/1990 |

(Continued)

*Primary Examiner* — Mahmoud Gimie

(74) *Attorney, Agent, or Firm* — Morgan, Lewis & Bockius LLP

(57) ABSTRACT

A cam carrier module for vehicles may include a cam carrier coupled with a cylinder head, an injector penetrating through the cam carrier and the cylinder head, and a sealing device provided between the cam carrier and the cylinder head and enclosing the injector to implement sealing of the injector.

11 Claims, 7 Drawing Sheets

(56) References Cited

FOREIGN PATENT DOCUMENTS

| | | | |
|---|---|---|---|
| JP | 5-195865 | A | 8/1993 |
| JP | 6-43243 | U | 6/1994 |
| JP | 2000-87716 | A | 3/2000 |
| JP | 2000-204918 | A | 7/2000 |
| JP | 2006-177208 | A | 7/2006 |
| JP | 2007-192105 | A | 8/2007 |
| JP | 2009-127587 | A | 6/2009 |
| KR | 10-0560013 | B1 | 3/2006 |
| WO | WO 2007/083223 | A1 | 7/2007 |

* cited by examiner

CAM CARRIER MODULE FOR VEHICLES

CROSS REFERENCE TO RELATED APPLICATION

The present application claims priority to Korean Patent Application No. 10-2014-0139789, filed Oct. 16, 2014, the entire contents of which is incorporated herein for all purposes by this reference.

BACKGROUND OF THE INVENTION

Field of the Invention

The present invention relates to a cam carrier module for vehicles, and more particularly, to a cam carrier module for vehicles for enhancing sealing performance by improving a sealing structure between a cam carrier and a cylinder head, conveniently assembling a cam shaft by simplifying a structure of the cam carrier, and increasing fuel efficiency by improving a friction of a driving system by applying a rolling bearing.

Description of Related Art

A cylinder head of an engine is provided with a pair of an intake cam shaft and an exhaust cam shaft which is operated together with a crank shaft by a chain or a belt. The cam shaft is provided with cams having different phase angles depending on each cylinder, and thus an intake valve and an exhaust valve are opened and closed at a defined period.

Further, the cam shaft is equipped in the cylinder head by a cam cap which is fastened with an upper portion of a cam shaft journal, in which the cam shaft journal may be directly formed in the cylinder head or formed in a cam carrier which is a separate part equipped in the cylinder head by a bolt.

FIG. 1 is a diagram for describing a configuration of the cam carrier and an assembling process of the cam shaft according to the related art. To assemble the cam shaft, first, a cam cap 5 is assembled in a cam body 3 which is formed in a cam carrier 1 and then a journal is machined.

Next, the cam cap 5 is again separated from the cam body 3 and the cam shaft and the cam cap 5 are assembled in the cam body 3, such that the assembling of the cam shaft in the cam carrier 1 may be completed.

As such, since the existing cam carrier module has a structure in which the cam carrier is separated from the cam cap, to assemble the cam shaft, a complicated process to assemble and disassemble the cam cap in and from the cam carrier needs to be performed. Further, a quality of products may be reduced and man hours may be increased, due to the complicated assembling process.

Further, a bearing (ball or needle type) structure is hardly applied to the cam shaft journal, and as a result, it is difficult to additionally reduce a friction and thus increase fuel efficiency.

In particular, in the case of an engine of a type in which an injector directly injects fuel into the cylinder, the injector may be provided, while penetrating through the cam carrier and the cylinder head. In this case, when gas is leaked from the injector, a serious problem of oil carbonization, and the like due to the leaked gas introduced into the engine may occur.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a cam carrier module for vehicles capable of enhancing sealing performance by improving a sealing structure between a cam carrier and a cylinder head.

Additionally, various aspects of the preset invention are directed to providing a cam carrier module for vehicles capable of conveniently assembling a cam shaft by simplifying a structure of a cam carrier and increasing fuel efficiency by improving a friction of a driving system by applying a rolling bearing.

According to various aspects of the preset invention, a cam carrier module for vehicles, may include a cam carrier coupled with a cylinder head, an injector penetrating through the cam carrier and the cylinder head, and a sealing device provided between the cam carrier and the cylinder head and enclosing the injector to implement sealing of the injector.

The sealing device may include an injector fixed part provided at a middle of the cam carrier, having a bottom surface adhered to the cylinder head and provided with an injector hole through which the injector is inserted, a sealing groove formed on the bottom surface of the injector fixed part and enclosing the injector hole, and a gasket provided in the sealing groove and made of an elastic material sealing between the cam carrier and the cylinder head.

The gasket is configured to protrude to an outside of the sealing groove to adhere the cylinder head.

The cam carrier module mat further may include a detection groove provided on the bottom surface of the injector fixed part and having a first end connected to a portion of the sealing groove and a second end configured to open toward a side of the injector fixed part.

An edge part is provided to form an edge of the cam carrier, wherein a bottom surface of the edge part and a top surface of the cylinder head are bonded by a sealing adhesive, and wherein a width of the bottom surface of the edge part is narrower than a width of the top surface of the cylinder head to form a bonding band by the sealing adhesive along a line at which a side of the edge part meets the top surface of the cylinder head.

The bonding band is configured to be formed by squeezing out a portion of the sealing adhesive applied between the cylinder head and the edge part when the top surface of the cylinder head is bonded with the bottom surface of the edge part.

All of a top surface and the bottom surface of the edge part and the top surface of the cylinder head and a bottom surface of the cylinder head cover which adheres thereto may have a flat shape.

A plurality of journal parts each is configured to enclose a cam shaft so that the cam shaft is provided along a length direction of the cam carrier and the journal parts are integrally formed.

The cam carrier module may further may include a first oil channel formed in the cylinder head and having a first end connected to a main gallery at a cylinder head side and a second end connected to the top surface of the cylinder head, and a second oil channel formed in the cam carrier and having a first end connected to the second end of the first oil channel and a second end connected to an inner surface of a journal forming each journal part.

The first end of the first oil channel and the main gallery at the cylinder head side are each connected to a cylinder head fastening bolt hole for fastening between the cylinder head and a cylinder block to facilitate oil flow.

A bottom surface of the cam carrier is provided with a recess and the first end of the second oil channel and the second end of the first oil channel are connected to the recess to facilitate the oil flow.

The recess is formed at an end of a cam carrier fastening bolt hole for fastening between the cam carrier and the cylinder head.

The journal part adjacently disposed to a sprocket operated together with a crank shaft among the journal parts is provided with a rolling bearing to enable the cam shaft to perform a rolling friction.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A cam carrier module for vehicles according to various embodiments of the present invention is configured to largely include a cam carrier 100, an injector 200, and a sealing device.

Figure 1:
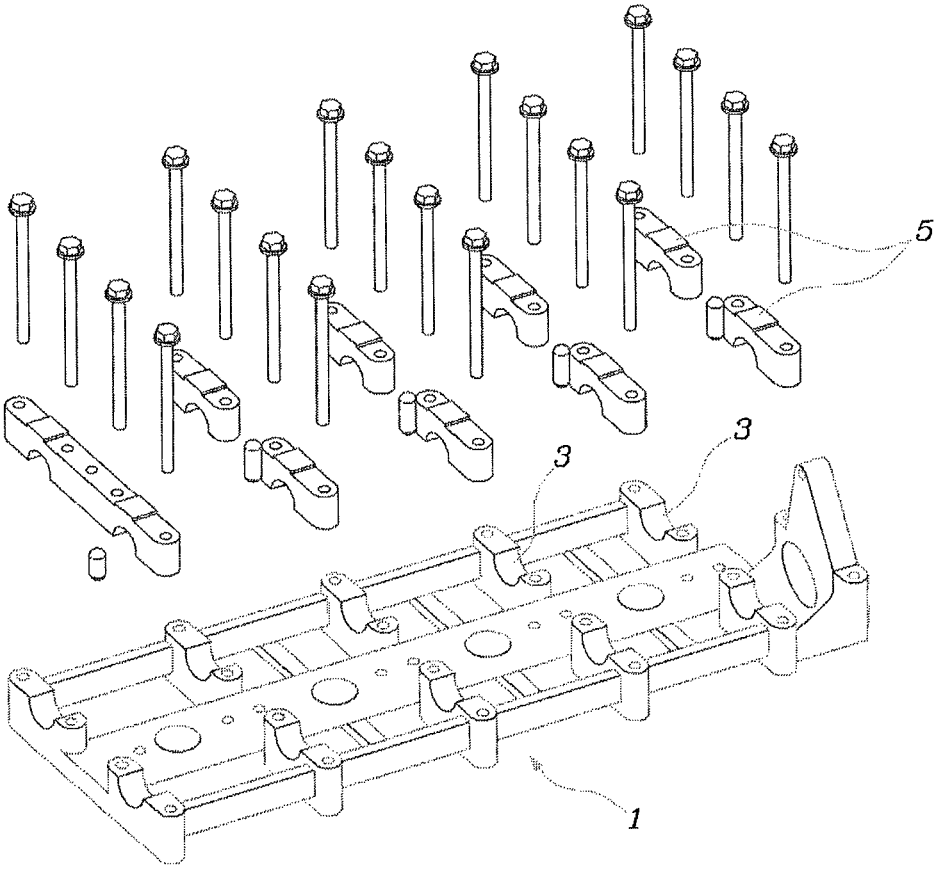
FIG. 1 (Related Art)
FIG. 1 is a diagram for describing a shape of a cam carrier according to the related art and an assembling process of a cam shaft in the cam carrier.
Figure 2:
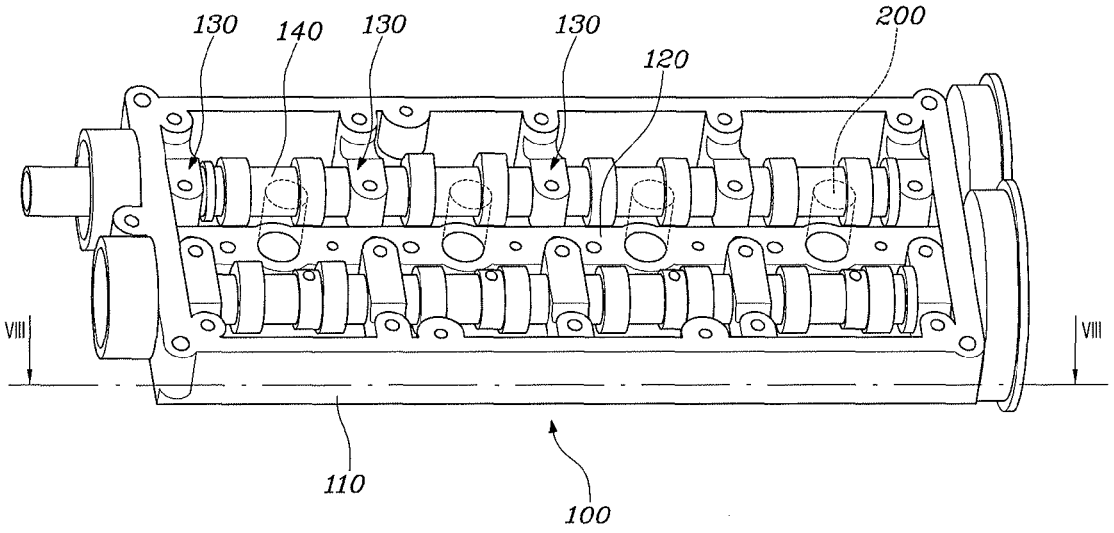
FIG. 2 is a diagram illustrating a shape of an exemplary cam carrier module according to the present invention and a structure of the exemplary cam carrier module in which a cam shaft is assembled.
Figure 3A:
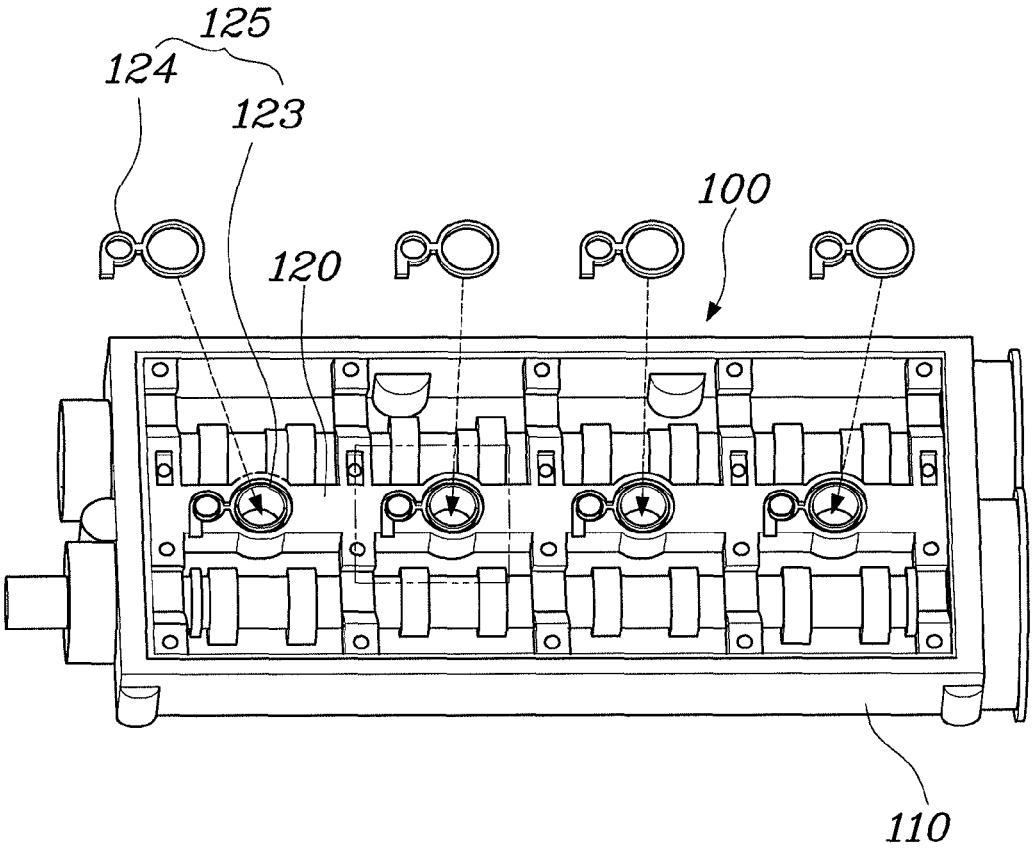
FIG. 3A and FIG. 3B are diagrams illustrating a structure of a sealing device which is provided in the exemplary cam carrier module according to the present invention.
Figure 3B:
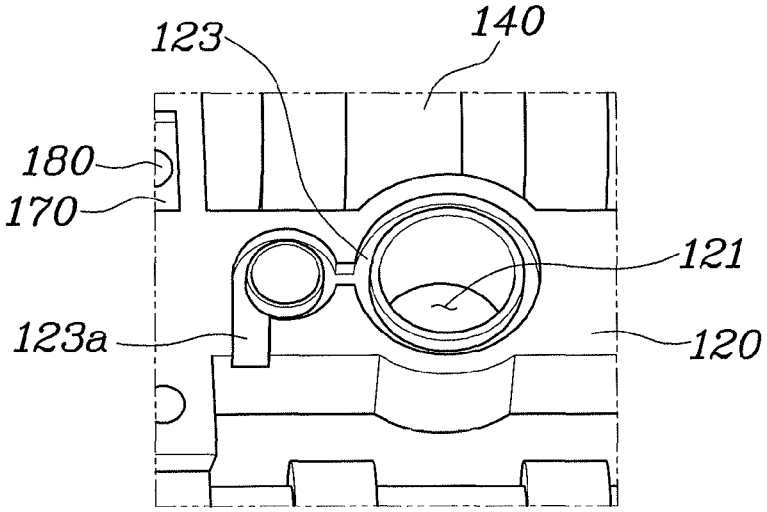

Describing in detail with reference to FIG. 2, FIG. 3A and FIG. 3B, first, the cam carrier 100 is disposed between a cylinder head 300 and a cylinder head cover to be longitudinally assembled with a cam shaft 140, in which a bottom surface of the cam carrier 100 is coupled with a top surface of the cylinder head 300.

Further, the injector 200 is to inject fuel into a cylinder and is provided to penetrate through the cam carrier 100 and the cylinder head 300, such that the fuel injected from the injector 200 may be directly injected into a combustion chamber inside the cylinder.

Next, the sealing device 125 is provided to enclose the injector 200 between the cam carrier 100 and the cylinder head 300 to seal the injector 200 when gas is leaked from the injector 200.

For example, describing in more detail a structure of the sealing device 125 with reference to FIG. 3, an injector fixed part 120 is lengthily formed at a middle of the cam carrier 100 in a length direction and a bottom surface of the injector fixed part 120 adheres to the top surface of the cylinder head 300. Further, a plurality of injector holes 121 are formed along the injector fixed part 120 and thus the injector 200 is provided to penetrate through the injector hole 121. In this case, the injector holes 121 are formed in each cylinder and thus the injectors 200 need to be individually provided in each cylinder.

In particular, the bottom surface of the injector fixed part 120 is provided with a sealing groove 123 having a shape enclosing the injector hole 121. Further, a gasket 124 of an elastic material such as rubber is provided within the sealing groove 123 to seal between the cam carrier 100 and the cylinder head 300.

In this case, although not illustrated in the drawings, the gasket 124 may be formed in a shape corresponding to the sealing groove 123.

By the configuration, according to various embodiments of the present invention, the interface between the cam carrier 100 into which the injector 200 is inserted and the cylinder head 300 is sealed with the gasket 124 to prevent gas leaked from the injector 200 from being discharged into an engine, such that it is possible to prevent a serious problem of oil carbonization, and the like in the engine from occurring.

In addition, the gasket protrudes to the outside of the sealing groove 123 and thus may adhere to the top surface of the cylinder head 300. That is, a thickness of the gasket is provided to be longer than a depth of the sealing groove 123, and thus the gasket is pressed onto the top surface of the cylinder head 300, such that it is possible to more firmly seal between the injector fixed part 120 and the cylinder head 300.

Further, the bottom surface of the injector fixed part 120 may be provided with a detection groove 123*a* which has one end connected to a portion of the sealing groove 123 and the other end having a shape which is opened toward the injector fixed part 120.

That is, in the case in which the gasket is inserted into the sealing groove 123 to assemble the cam carrier 100 in the cylinder head 300, when the gasket is inserted into the sealing groove 123 and is thus normally assembled, a portion of the gasket protrudes to the outside of the detection groove 123*a* by a pressure applied to the gasket and when the gasket deviates from the sealing groove 123 and is thus abnormally assembled, the gasket does not protrude to the outside of the detection groove 123*a*.

Therefore, after the cam carrier 100 is assembled in the cylinder head 300, it is determined whether the gasket protruding to the outside of the detection groove 123*a* is present to confirm and detect whether the gasket is normally assembled, thereby preventing the assembling defect.

Here, one side of the injector hole 121 may be further provided with a fastening bolt insertion hole through which a fastening bolt bolted to the cylinder head 300 penetrates. In this case, as illustrated, the sealing groove 123 may be formed to enclose the injector hole 121 and the fastening bolt insertion hole.

Figure 4:
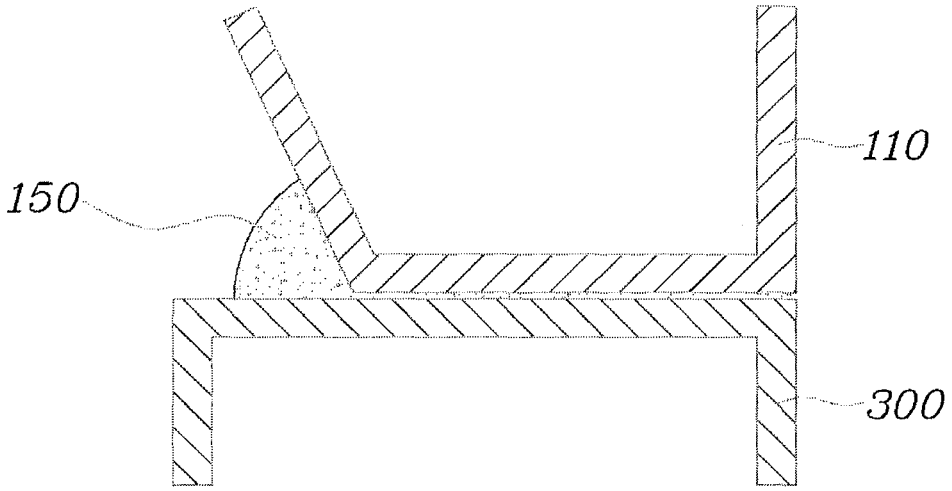
FIG. 4 is a diagram illustrating a structure in which the exemplary cam carrier is bonded with a cylinder head according to the present invention.

Further, referring to FIG. 2, FIG. 3, and FIG. 4, according to various embodiments of the present invention, an edge part 110 to form an edge of the cam carrier 100 is provided and a sealing adhesive is applied between a bottom surface of the edge part 110 and the top surface of the cylinder head 300 to bond between the edge part 110 and the cylinder head 300.

In this case, a width forming the bottom surface of the edge part 110 is formed to be narrower than that forming the top surface of the cylinder head 300 and a side of the edge part 110 is bonded with the top surface of the cylinder head 300 along a line at which the side of the edge part 110 meets the top surface of the cylinder head 300 by the sealing adhesive, such that a bonding band 150 may be formed along the line.

For example, the bonding band 150 may be formed by squeezing a portion of the sealing adhesive applied between the cylinder head 300 and an edge part 110 when the top surface of the cylinder head 300 is bonded with the bottom surface of the edge part 110. Here, the sealing adhesive may be a sealant.

That is, by the bonding by the sealing adhesive together with the sealing device and the configuration of the bonding band 150, between the cam carrier 100 and the cylinder head 300 is formed in a multiple sealing structure, thereby further enhancing the sealing performance.

Further, according to various embodiments of the present invention, all of the top surface and the bottom surface of the edge part 110 and the top surface of the cylinder head 300 and the bottom surface of the cylinder head cover which adhere thereto may have a flat shape.

That is, according to the related art, a corner portion of the cam carrier 100 is provided with a T-JOINT part and thus the cam carrier 100 is coupled to the cylinder head 300 and the cylinder head cover, but according to various embodiments of the present invention, the cylinder head 300 and the cam carrier 100 and the cylinder head cover may be firmly coupled with each other while removing a T-JOINT part by the sealing structure and maintaining the sealing performance therebetween.

Meanwhile, according to various embodiments of the present invention, a plurality of journal parts 130 may have a shape enclosing the cam shaft 140 so that the cam shaft 140 is provided along the length direction of the cam carrier 100. Here, the journal parts 130 may be disposed at both sides based on the injector fixed part 120, while facing each other and may be disposed in a shape connecting between the side of the injector fixed part 120 and the edge part 110. Here, the cam shaft 140 may be an intake cam shaft and an exhaust cam shaft.

In particular, the journal part 130 may be integrally formed and the journal part 130 is integrally formed in the edge part 110 and the injector fixed part 130, such that the cam carrier 100 may be integrally formed.

That is, the related art has the structure in which the cam cap 5 is assembled on the upper portion of the cam carrier 1 to form the journal, but the present invention has the structure in which the journal part 130 is integrally formed to form the journal 131, thereby conveniently assembling the cam shaft 140 in the journal 131.

Figure 5:
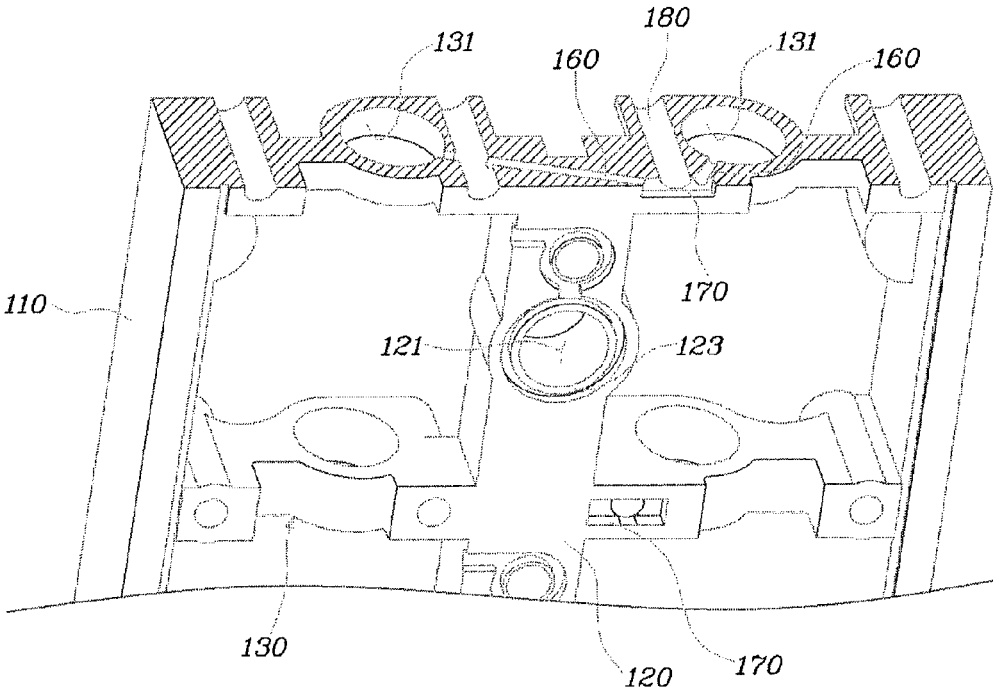
FIG. 5 is a cut-out view of a portion of the exemplary cam carrier for describing a structure of a second oil channel and a recess according to the present invention.
Figure 6:
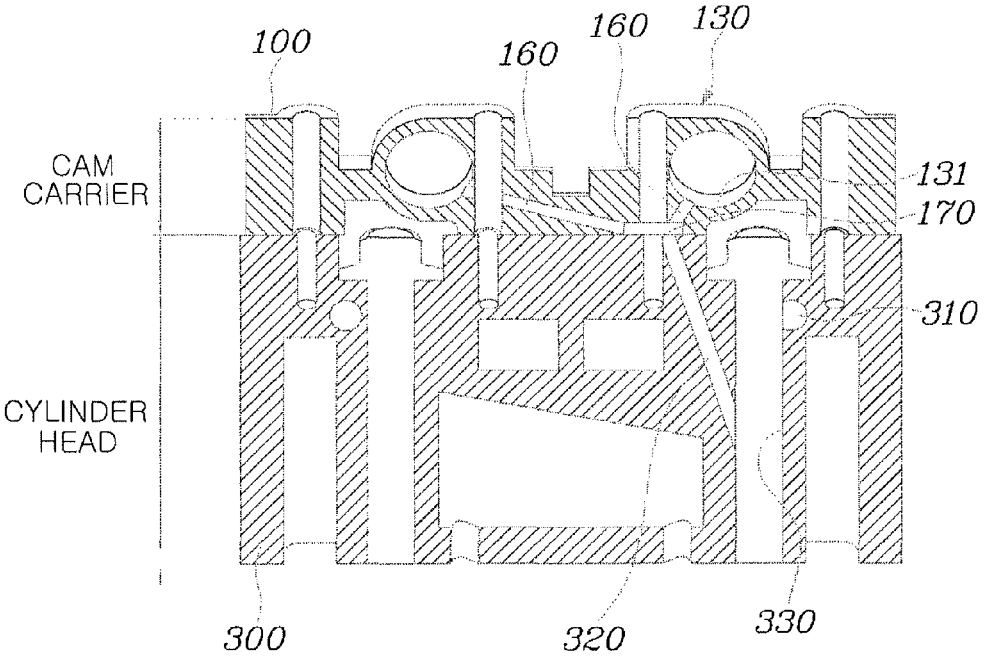
FIG. 6 is a diagram illustrating a connection relationship between a first oil channel and the second oil channel according to the present invention.
Figure 7:
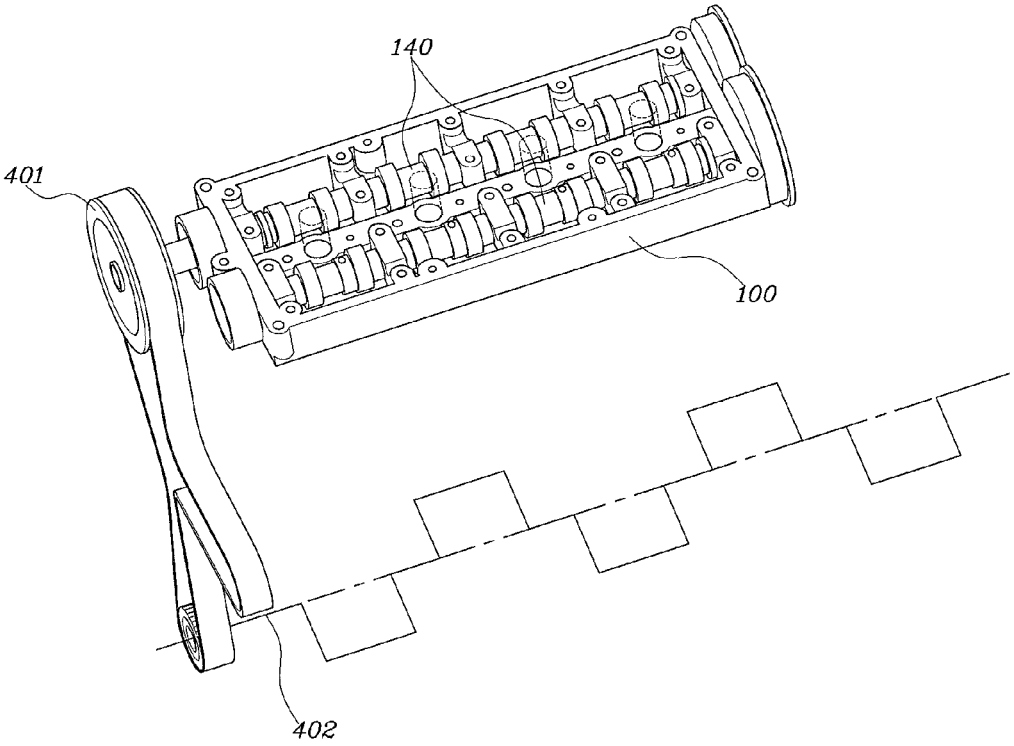
FIG. 7 is a diagram illustrating power transmitting from crankshaft to cam shaft of the exemplary cam carrier.
Figure 8:
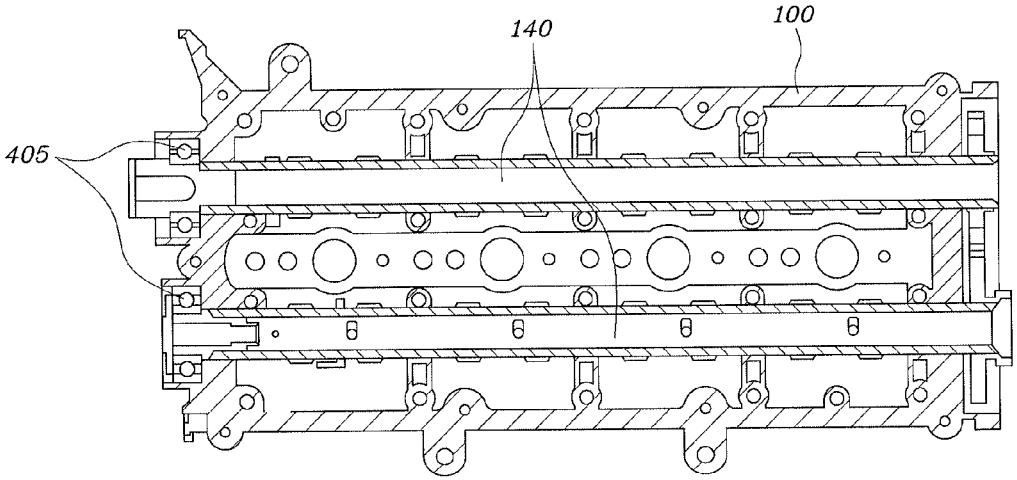
FIG. 8 is a sectional view of line VIII-VIII of FIG. 2.

Further, according to various embodiments of the present invention, referring to FIG. 5 and FIG. 6, a channel through which oil flows is formed in the cylinder head 300 and the journal 130 to make oil flow into the journal 131, thereby reducing the friction of the cam shaft 140 assembled in the journal part 130.

For example, a first oil channel 320 is formed in the cylinder head 300. The first oil channel 320 has one end connected to a main gallery 310 at the cylinder head side and the other end connected to the top surface of the cylinder head 300 and thus is connected to a second oil channel 160 described below.

In this case, one end of the first oil channel 320 and the main gallery 310 at the cylinder head side are each connected to the cylinder head fastening bolt hole 330 formed in the cylinder head 300 for fastening between the cylinder head 300 and a cylinder block, such that oil flows from the main gallery 310 at the cylinder head side to the first oil channel 320.

Further, the cam carrier 100 is provided with the second oil channel 160. One end of the second oil channel 160 is connected to the other end of the first oil channel 320 and the other end thereof is connected to an inner surface of the journal 131 forming the journal part 130 to supply the oil flowing through the first oil channel 320 and the second oil channel 160 to the inner surface of the journal 131, thereby reducing the friction of the cam shaft 140 assembled in the journal part 130.

Further, on the bottom surface of the cam carrier 100, a point at which the one end of the first oil channel 320 and the other end of the second oil channel 160 meet each other is provided with a recess 170. That is, the one end of the second oil channel 160 is connected to the other end of the first oil channel 320 to make the oil flow in the recess 170 and thus the oil flows from the first oil channel 320 to the second oil channel 160.

Here, the cam carrier 100 is longitudinally provided with the cam carrier fastening bolt hole 180 for fastening between the cam carrier 100 and the cylinder head 300, in particular, the recess 170 is formed at a lower end of the cam carrier fastening bolt hole 180, thereby implementing a structure suitable to form a surface pressure.

By the above configuration, the oil of the main gallery 310 flows along the first oil channel 320 formed in the cylinder head 300 and the oil flowing along the first oil channel 320 is supplied to the inner surface of the journal 131 while flowing along the second oil channel 160 formed in the cam carrier 100. Therefore, lubrication performance of the cam shaft 140 shaft-coupled with the journal 131 is enhanced and the friction is reduced, and as a result, the fuel efficiency is improved.

Further, although not illustrated, the journal part 130 adjacently disposed to the sprocket 401 operated together with the crank shaft 402 in the journal part 130 may be provided with a rolling bearing 405 to enable the cam shaft 140 to perform a rolling friction.

That is, the sprocket 401 rotates together with the crank shaft by a driving belt/chain, and the like which are connected to the crank shaft 402, and thus the journals 131 of the journal parts 130 adjacent to the sprocket 401 are applied with a larger load by the cam shaft 140 than that of the journals 131 formed in the rest journal parts 130, such that the journal part 130 adjacent to the sprocket is applied with the rolling bearing 405 such as a ball bearing and a needle bearing, thereby reducing the friction due to the rotation of the cam shaft 140.

According to the various embodiments of the present invention, it is possible to reduce the occurrence risk of oil carbonization, and the like, by preventing the gas leaked from the injector from being discharged into the engine by sealing the interface between the cam carrier 100 into which the injector 200 is inserted and the cylinder head 300 with the gasket and reduce the labor hours involved in the assembling of the cam shaft by conveniently assembling the cam shaft in the journal due to the structure of the journal part which is integrally formed, thereby improving the quality of products.

Further, it is possible to increase the fuel efficiency by improving the friction due to the rotation of the cam shaft by applying the rolling bearing such as the ball bearing and the needle bearing to the journal part adjacent to the sprocket.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cam carrier module for vehicles, comprising:

a cam carrier coupled with a cylinder head;

an injector penetrating through the cam carrier and the cylinder head;

a sealing device provided between the cam carrier and the cylinder head and enclosing the injector to implement sealing of the injector, wherein the sealing device includes:

an injector fixed part provided at a middle of the cam carrier, having a bottom surface adhered to the cylinder head and provided with an injector hole through which the injector is inserted;

a sealing groove formed on the bottom surface of the injector fixed part and enclosing the injector hole; and a gasket provided in the sealing groove and made of an elastic material sealing between the cam carrier and the cylinder head; and a detection groove provided on the bottom surface of the injector fixed part and having a first end connected to a portion of the sealing groove and a second end configured to open toward a side of the injector fixed part.

2. The cam carrier module of claim 1, wherein the gasket is configured to protrude to an outside of the sealing groove to adhere the cylinder head.

3. The cam carrier module of claim 1, wherein an edge part is provided to form an edge of the cam carrier, wherein a bottom surface of the edge part and a top surface of the cylinder head are bonded by a sealing adhesive, and wherein a width of the bottom surface of the edge part is narrower than a width of the top surface of the cylinder head to form a bonding band by the sealing adhesive along a line at which a side of the edge part meets the top surface of the cylinder head.

4. The cam carrier module of claim 3, wherein the bonding band is configured to be formed by squeezing out a portion of the sealing adhesive applied between the cylinder head and the edge part when the top surface of the cylinder head is bonded with the bottom surface of the edge part.

5. The cam carrier module of claim 3, wherein all of a top surface and the bottom surface of the edge part and the top surface of the cylinder head and a bottom surface of the cylinder head cover which adheres thereto have a flat shape.

6. The cam carrier module of claim 1, wherein a plurality of journal parts each is configured to enclose a cam shaft so that the cam shaft is provided along a length direction of the cam carrier and the journal parts are integrally formed.

7. The cam carrier module of claim 6, further comprising:

a first oil channel formed in the cylinder head and having a first end connected to a main gallery at a cylinder head side and a second end connected to the top surface of the cylinder head; and a second oil channel formed in the cam carrier and having a first end connected to the second end of the first oil channel and a second end connected to an inner surface of a journal forming each journal part.

8. The cam carrier module of claim 7, wherein the first end of the first oil channel and the main gallery at the cylinder head side are each connected to a cylinder head fastening bolt hole for fastening between the cylinder head and a cylinder block to facilitate oil flow.

9. The cam carrier module of claim 7, wherein a bottom surface of the cam carrier is provided with a recess and the first end of the second oil channel and the second end of the first oil channel are connected to the recess to facilitate the oil flow.

10. The cam carrier module of claim 9, wherein the recess is formed at an end of a cam carrier fastening bolt hole for fastening between the cam carrier and the cylinder head.

11. The cam carrier module of claim 7, wherein the journal part adjacently disposed to a sprocket operated together with a crank shaft among the journal parts is provided with a rolling bearing to enable the cam shaft to perform a rolling friction.

* * * * *